US006802506B2

(12) United States Patent
Spende

(10) Patent No.: US 6,802,506 B2
(45) Date of Patent: Oct. 12, 2004

(54) ENTRY TICKET IN THE SYSTEM OF NUMERICAL GAMES OF CHANCE AND METHOD OF COMPLETING THE SAID TICKET

(76) Inventor: Bojan Spende, Sisenska 2, Ljubljana (SI), 1000

( * ) Notice: Subject to any disclaimer, the term of this patent is extended or adjusted under 35 U.S.C. 154(b) by 0 days.

(21) Appl. No.: 10/239,771

(22) PCT Filed: Dec. 28, 2000

(86) PCT No.: PCT/SI00/00031

§ 371 (c)(1),
(2), (4) Date: Nov. 7, 2002

(87) PCT Pub. No.: WO01/70353

PCT Pub. Date: Sep. 27, 2001

(65) Prior Publication Data

US 2003/0090058 A1 May 15, 2003

(30) Foreign Application Priority Data

Mar. 24, 2000 (SI) ..... P-200000083

(51) Int. Cl.[7] ..... A63F 3/06

(52) U.S. Cl. ..... 273/139; 273/138.1; 273/148 R; 283/903

(58) Field of Search ..... 273/148 R, 139, 273/138.1, 138.2, 274, 269; 283/901, 903

(56) References Cited

U.S. PATENT DOCUMENTS 4,795,161 A * 1/1989 Chao ..... 273/292
5,110,129 A * 5/1992 Alvarez ..... 273/138 A
5,118,110 A * 6/1992 Jones ..... 273/141 R
5,232,222 A * 8/1993 Deutch ..... 273/142 HA
6,371,482 B1 * 4/2002 Hall, Jr. ..... 273/138.1

OTHER PUBLICATIONS

"Powerball", www.playlot.com.*

* cited by examiner

*Primary Examiner*—Benjamin Layno
(74) *Attorney, Agent, or Firm*—King & Jovanovic, PLC

(57) ABSTRACT

The subject of the invention is the entry ticket in the system of numerical games of chance and the method of completing the said ticket. The uniquely marked ticket is the element by which the player enters the game. The ticket layout features numerical date-time and astrological fields where date, numerology and astrology related events provide the inspiration to the player as to which numerical selections to make. The player thus creates the entry combination, which is subsequently matched against the randomly drawn combination oft eh organizer of the game of chance.

5 Claims, 3 Drawing Sheets

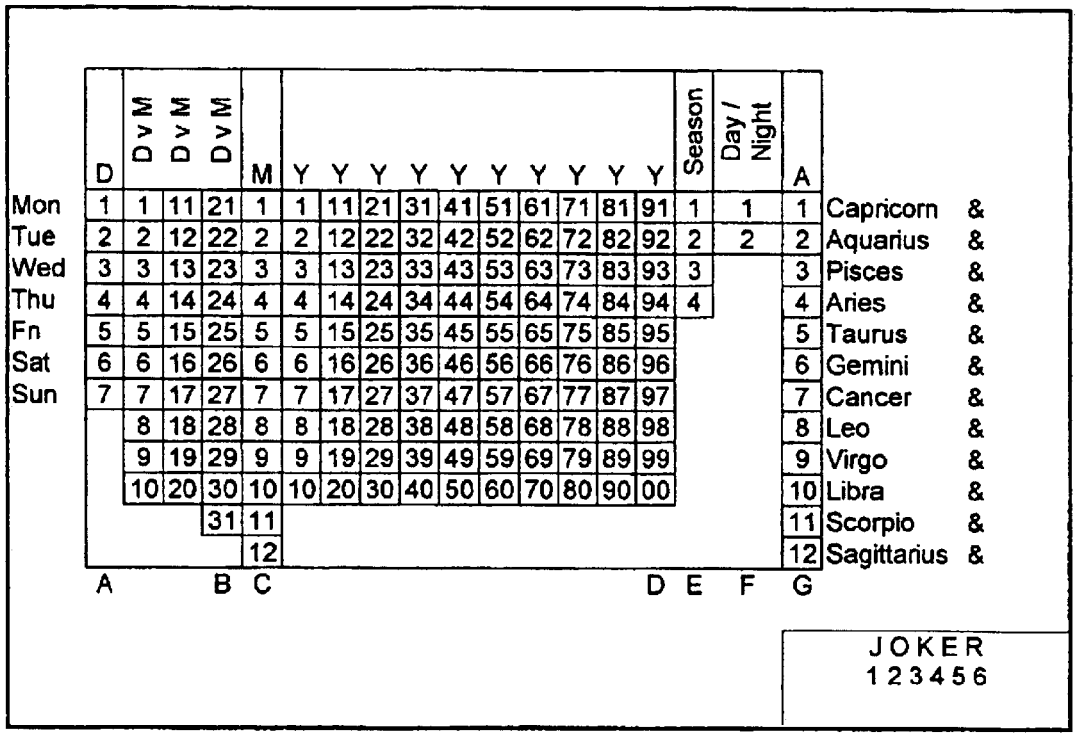

| | D | D v M | D v M | D v M | M | Y | Y | Y | Y | Y | Y | Y | Y | Y | Y | Season | Day / Night | A | | |
|---|---|---|---|---|---|---|---|---|---|---|---|---|---|---|---|---|---|---|---|---|
| Mon | 1 | 1 | 11 | 21 | 1 | 1 | 11 | 21 | 31 | 41 | 51 | 61 | 71 | 81 | 91 | 1 | 1 | 1 | Capricorn | & |
| Tue | 2 | 2 | 12 | 22 | 2 | 2 | 12 | 22 | 32 | 42 | 52 | 62 | 72 | 82 | 92 | 2 | 2 | 2 | Aquarius | & |
| Wed | 3 | 3 | 13 | 23 | 3 | 3 | 13 | 23 | 33 | 43 | 53 | 63 | 73 | 83 | 93 | 3 | | 3 | Pisces | & |
| Thu | 4 | 4 | 14 | 24 | 4 | 4 | 14 | 24 | 34 | 44 | 54 | 64 | 74 | 84 | 94 | 4 | | 4 | Aries | & |
| Fn | 5 | 5 | 15 | 25 | 5 | 5 | 15 | 25 | 35 | 45 | 55 | 65 | 75 | 85 | 95 | | | 5 | Taurus | & |
| Sat | 6 | 6 | 16 | 26 | 6 | 6 | 16 | 26 | 36 | 46 | 56 | 66 | 76 | 86 | 96 | | | 6 | Gemini | & |
| Sun | 7 | 7 | 17 | 27 | 7 | 7 | 17 | 27 | 37 | 47 | 57 | 67 | 77 | 87 | 97 | | | 7 | Cancer | & |
| | | 8 | 18 | 28 | 8 | 8 | 18 | 28 | 38 | 48 | 58 | 68 | 78 | 88 | 98 | | | 8 | Leo | & |
| | | 9 | 19 | 29 | 9 | 9 | 19 | 29 | 39 | 49 | 59 | 69 | 79 | 89 | 99 | | | 9 | Virgo | & |
| | | 10 | 20 | 30 | 10 | 10 | 20 | 30 | 40 | 50 | 60 | 70 | 80 | 90 | 00 | | | 10 | Libra | & |
| | | | | 31 | 11 | | | | | | | | | | | | | 11 | Scorpio | & |
| | | | | | 12 | | | | | | | | | | | | | 12 | Sagittarius | & |
| | A | | | B | C | | | | | | | | | | D | E | F | G | | |

JOKER
1 2 3 4 5 6

FIG. 1

| Weekday | Day in Month | | Month | Last Two Digits of the Year | | Astrological Sign | Season | Hour | |
|---|---|---|---|---|---|---|---|---|---|
| 1 Monday | 1 | 1 | 1 January | 00 | 1900 | 1 Capricorn | 1 Spring | 1 | 1 |
| 2 Tuesday | 2 | 2 | 2 February | 01 | 1901 | 2 Aquarius | 2 Summer | 2 | 2 |
| 3 Wednesday | 3 | 3 | 3 March | 02 | 1902 | 3 Pisces | 3 Autumn | 3 | 3 |
| 4 Thursday | 4 | 4 | 4 April | 03 | 1903 | 4 Aries | 4 Winter | 4 | 4 |
| 5 Friday | .. | .. | 5 May | .. | .. | 5 Taurus | | .. | .. |
| 6 Saturday | .. | .. | 6 June | .. | .. | 6 Gemini | | .. | .. |
| 7 Sunday | .. | .. | 7 July | .. | .. | 7 Cancer | | .. | .. |
| | .. | .. | 8 August | .. | .. | 8 Leo | | .. | .. |
| | 28 | 28 | 9 September | 96 | 1996 | 9 Virgo | | 21 | 21 |
| | 29 | 29 | 10 October | 97 | 1997 | 10 Libra | | 22 | 22 |
| | 30 | 30 | 11 November | 98 | 1998 | 11 Scorpio | | 23 | 23 |
| | 31 | 31 | 12 December | 99 | 1999 | 12 Sagittarius | | 24 | 24 |

| Even / Odd | Minute | | Moon's Seasons | Morning / Afternoon | Decade in Month | Day / Night | Week in Year | |
|---|---|---|---|---|---|---|---|---|
| 1 Even | 1 | 1 | 1 New Moon | 1 Morning | 1 First decade | 1. Day | 1 | 1 |
| 2 Odd | 2 | 2 | 2 First Quarter | 2 Afternoon | 2 Second decade | 2 Night | 2 | 2 |
| | 3 | 3 | 3 Full Moon | | 3 Third decade | | 3 | 3 |
| | 4 | 4 | 4 Last Quarter | | | | 4 | 4 |
| | .. | .. | | | | | .. | .. |
| | .. | .. | | | | | .. | .. |
| | .. | .. | | | | | .. | .. |
| | .. | .. | | | | | .. | .. |
| | 57 | 57 | | | | | 51 | 51 |
| | 58 | 58 | | | | | 52 | 52 |
| | 59 | 59 | | | | | 53 | 53 |
| | 60 | 60 | | | | | 54 | 54 |

FIG. 2

| Hits | Probability of Hits from | Probability of Hits to | Reward Fund |
|---|---|---|---|
| 7 | 1 : 12,096,000 | 1 : 12,096,000 | 30% |
| 6 | 1 : 120,960 | 1 : 8,048,000 | 10% |
| 5 | 1 : 4,032 | 1 : 3,024,000 | 10% |
| 4 | 1 : 336 | 1 : 432,000 | 15% |
| 3 | 1 : 28 | 1 : 36,000 | 35% |
| 2 | 1 : 4 | 1 : 3,000 | 0% |

FIG. 3

ENTRY TICKET IN THE SYSTEM OF NUMERICAL GAMES OF CHANCE AND METHOD OF COMPLETING THE SAID TICKET

BACKGROUND OF THE INVENTION

The subject of the invention is the entry ticket in the system of numerical games of chance and the method of completing the said ticket. The uniquely marked ticket is the element by which the player enters the game. The ticket layout features numerical date-time and astrological fields where date-, numerology and astrology related events provide the inspiration to the player as to which numerical selections to make. The player thus creates the entry combination, which is subsequently matched against the randomly drawn combination of the organiser of the game of chance. The invention belongs to the classes A63F 3/06 or A63F 3/08 of the international patent classification.

On the gambling market, there are a number of conventional numerical games of chance (lottery, bingo etc.) where entry combinations of arbitrarily determined (meaningless) and selected numbers are matched against the randomly drawn winning combination.

People associate with astrology and numerology in a certain way, which is also reflected in human reactions and behaviour. The positions of the planets determining the astrological (zodiac) sign of the individual, combined with the date and time of birth whereby his/her characteristics and the flow of future events can be mapped out in even more detail, represent the basis on which biorhythm calendars, horoscopes, (un)lucky days and other periods, (un)lucky numbers etc. are being determined. In a game of chance offering the selection of the zodiac sign, day, month, year or lucky number, the player has the opportunity to incorporate these predictive elements into the game itself. The innovative solution offers a range of meaningful date, numerology and astrology related elements, thus enabling the player to include his/her expectations from the participation in the game by those selecting dates, times and zodiac signs to which he/she attributes a certain meaning (the entry combination). This way of providing means of expression in relation to the anticipation of the future as well as faith into the choice of a lucky number, zodiac sign or date, imbues the entry combination with meaning and involves players' motivation, while the game as such remains simple and distinctive.

In the conventional numerical games of chance, the probability of winning a prize is determined by the number of selected numbers from the total pool of numbers. As a rule, the prize fund of this type of games is structured into orders of prizes (e.g. 7—"seven", 6+1, 6—"six", etc.). The size of the overall prize fund is determined by the rules, while the value of the individual prizes of a certain order is calculated on the basis of the number of winning combinations of each order of prizes. For each order of prizes, the probability of winning a prize is determined by a single ratio.

On the other hand, the entry ticket and the way it is filled in (as per the invention) introduces a range of possible combinations of time-calendar and astrology related elements into the game—thus achieving the flexibility enabling a modular selection of the play with a set/desired probability of winning a prize as well as a set/desired number of prizes, while simultaneously adapting to the market size as well as customer needs and wants. With the modular approach, individual orders of prizes are no longer limited to a single probability value of winning a prize; instead, there is a whole range of probability values for each order. Various weighting factors introduce a dynamic quality into the play, thus increasing the attractiveness of the game as well as the motivation of the players.

The new version of the entry ticket enables the participant in the game to link the selection of the elements of the play to the time- and calendar related events, numerology and astrology, thus providing the player with the opportunity of introducing his/her own expectations into the game. This way of providing means of expression in relation to the anticipation of the future as well as faith into the choice of a lucky number, zodiac sign or date, brings meaning to the entry combination and involves motivation, while the game as such remains simple and distinctive.

At the same time, the innovative version of the entry ticket (as per the invention) with its range of possible combinations of the elements of the game enabling a selection of play with a set/desired probability of winning a prize as well as a set/desired number of prizes, offers a degree of modularity which makes it possible for the organiser to adapt to the size and needs of the market. The number and variability of the entry combinations gives the organiser the flexibility of choice in terms of selecting the degree of risk involved. In addition, this new approach in the way the game of chance is organised, with its palette of ways in which the elements may be combined, offers the modularity enabling a range of probability values in relation to winning a prize within each order of prizes.

The subject of the invention is the entry ticket in the system of numerical games of chance and the method of completing the said ticket. The uniquely marked ticket is the element by which the player enters the game. The ticket layout features numerical date-time and astrological fields where date related events, numerology and astrology provide the inspiration to the player as to which numerical values to select. The player thus creates the entry combination, which is subsequently matched against the randomly drawn combination of the organiser of the game of chance.

BRIEF DESCRIPTION OF THE DRAWINGS

The invention shall be described in detail on the basis of an example accompanied by drawings as follows:

FIG. 1 sample ticket with values filled in in accordance with the proposed method;

FIG. 2 table of fields and possible variant solutions for the coding of the field elements;

FIG. 3 table of sample calculation of prize funds and probability intervals (frequency) of individual orders of prizes;

DETAILED DESCRIPTION OF THE PREFERRED EMBODIMENT

The ticket, as shown in FIG. 1, consists of the fields (A, B, . . . ) ticket codes (ticket number, Joker), payment codes, control codes, etc. The format of the payment codes dependant on the hardware and on the required data—records kept by the Organiser of the games of chance—ensures that each entry code is unique. The field where the ticket number is to be entered, Joker, payment codes and barcode is designed to function on the same principle as bank terminals (entry space) and can be used in the place of the cash register printout (the receipt of the payment is printed on the ticket).

The sample ticket shown in FIG. 1 features the fields representing entire sets of data the contents of which are time or calendar related. The selection of the fields determines the target number of prizes and their values.

The fields marked on the ticket in FIG. 1 represent a selection from a range of values shown in FIG. 2: day of the week, day of the month, month, last two digits of a year, zodiac sign, season of the year, hour, odd/even, minute, day/night, morning/afternoon, decanate of the month, week of the year and phases of the Moon.

| Each field consists of boxes with numbers filled in, e.g.: | |
|---|---|
| 1 to 7 | day of the week |
| 1 to 31 | day of the month |
| 1 to 12 | month |
| 1 to 99 and 00 | year (abbreviated, e.g. 1900 => 00, . . . 1951 => 51, 1997 => 97, . . . ) |
| 1 to 4 | season of the year |
| 1 to 2 | day/night |
| 1 to 12 | zodiac sign |

Any combination of the fields on the ticket is possible, provided the fields are clearly defined (by colour, border, . . . ). The types of fields enable an infinite number of entry combinations. The selection of fields (within the bounds of their number—14) is flexible. Each different combination of fields on a ticket represents a new game. It is "new" due to its specific characteristics of the probability of winning a prize, "new" in respect of the structure of the prize fund, number of fields, number of large and small prizes, etc. From the fourteen fields, a finite number of different versions of the game can be established. Due to the theory of probabilities, however, a prize can only be won within a set of combinations of fields with the relevant probability value of winning a prize.

FIG. 3 features a table representing the highest and the lowest periodical probability (frequency) of the orders of prizes in relation to the type of the fields involved in the winning combination. Due to the variation in the range of the elements of the field, the fields have different weighting factors, resulting in the probability of a win for individual orders of prizes fluctuating between the highest and the lowest value.

The field where the ticket number is to be entered, Joker, payment codes and barcode is designed to function on the same principle as bank terminals (entry space) and can be used in the place of the cash register printout (the receipt of the payment is printed on the ticket).

In order to participate in the game, the player shall fill in a ticket attempting to foretell which numbers of the fields, representing time- and calendar related events, and zodiac signs, shall be drawn. In individual fields, the participant is trying to foretell which number shall be drawn in the relevant draw. The ticket is filled in by marking the desired number in the field with "x". The outcome is foretold on a single type of ticket, i.e. on the ticket for playing individual combinations, which is also a "system" ticket that can be used for playing a larger number of combinations at the same time.

Correctly marked combinations form the basis for the record-keeping, entry ticket payments, control and pay-out of prizes. The number of paid entry combinations is calculated by multiplying the numbers of the marked numbers in every single field.

The draw can be performed by using drums containing numbered balls.

| | | |
|---|---|---|
| Drum #1 | 1 to 7 | day of the week |
| Drum #2 | 1 to 31 | day of the month |
| Drum #3 | 1 to 12 | month |
| Drum #4 | 1 to 99 and 00 | year (abbreviated, e.g. 1900 => 00, . . . , 1951 => 51, 1997 => 97, . . . ) |
| Drum #5 | 1 to 4 | season of the year |
| Drum #6 | 1 to 2 | day/night |
| Drum #7 | 1 to 12 | zodiac sign |

One ball from each drum shall be drawn in each draw. The numbers on the balls drawn make up the winning combination. It is also possible for the winning combination to be determined by using a generator of random numbers for each field, taking into account the different contingents of the field numbers.

The proposed game may feature several types of prizes. In this case, the values of the prizes are determined in relation to the degree of probability, in accordance with the rules.

Payments, received for a particular draw, are deemed as the total of all amounts of the payments received for combinations entered. In addition to the conventional way of determining the prize fund structure for individual winning combinations (a "seven", a "six", a "five", etc.)—in accordance with the rules—as a percentage of the total entry payments made, the possibility of a fixed pay-out amount for a certain type of prize increases the attractiveness of the game and players' motivation. Thus, a decision may be made to determine the size of the prize fund for a particular order of prizes, and for the value of prizes, as a multiplier of the combination price (i.e. the pay-out amounts are fixed and not proportional to the size of the prize fund).

What is claimed is:

1. Entry ticket in the system of numerical games of chance, wherein each ticket comprises:

a plurality of fields, each field having a corresponding set of numerical data;

each set of numerical data being one of time, calendar and astrology related fields, wherein each set of numerical data includes a complete range of possible responses, and wherein at least three of the sets of numerical data include a different range of values, to, in turn, provide a different probability of selecting a winning value in each of the at least three of the sets of numerical data.

2. Entry ticket as recited in claim 1 wherein the plurality of fields comprises between three and fourteen fields.

3. Entry ticket as recited in claim 2 wherein the plurality of fields are selected from the group consisting of sets of numerical data which include the complete range of: zodiac signs, time or calendar, day of the week, day of the month, month, year, zodiac sign, season of the year, hour, odd/even, minute, day/night, morning/afternoon, decanate of the month, week of the year and phases of the Moon.

4. Entry ticket as recited in claims 1 wherein the a majority of the sets of numerical data comprise a different range of values.

5. A method of playing a game comprising the steps of:

providing an entry ticket, each entry ticket comprising:

a plurality of fields, each field having a corresponding set of numerical data;

each set of numerical data being one of time, calendar and astrology related fields, wherein each set of numerical data includes a complete range of possible responses, and wherein at least three of the sets of numerical data include a different range of values, to, in turn, provide a different probability of selecting a winning value in each of the at least three of the sets of numerical data;

providing a device for randomly selecting values corresponding to each of the sets of numerical data;

selecting one value from each of the plurality of fields of the entry ticket;

activating the device to randomly select values for each of the fields of the entry ticket; and determining which if any of the randomly selected values correspond to the selected values of the entry ticket.

* * * * *